United States Patent [19]

Toyoda

[11] 4,322,676

[45] Mar. 30, 1982

[54] BIAS CIRCUIT

[75] Inventor: Kazuhiro Toyoda, Yokohama, Japan

[73] Assignee: Fujitsu Limited, Kawasaki, Japan

[21] Appl. No.: 62,312

[22] Filed: Jul. 30, 1979

[30] Foreign Application Priority Data

Aug. 2, 1978 [JP] Japan ..... 53-94203

[51] Int. Cl.[3] ..... G05F 5/00

[52] U.S. Cl. ..... 323/303; 323/313; 323/907

[58] Field of Search ..... 307/296 R, 297; 323/8, 323/19, 22 T, 68, 225, 226, 279, 303, 312–315, 349, 907; 330/289

[56] References Cited

U.S. PATENT DOCUMENTS

| | | | |
|---|---|---|---|
| 3,828,241 | 8/1974 | Horichi | 323/22 T |
| 3,886,435 | 5/1975 | Steckler | 323/68 X |
| 3,956,661 | 5/1976 | Sakamoto et al. | 323/22 T |
| 4,061,959 | 12/1977 | Ahmed | 323/22 T |
| 4,157,493 | 6/1979 | Monticelli | 323/19 X |

FOREIGN PATENT DOCUMENTS

| | | | |
|---|---|---|---|
| 52-2254 | 1/1977 | Japan | 330/289 |

*Primary Examiner*—A. D. Pellinen
*Attorney, Agent, or Firm*—Staas & Halsey

[57] ABSTRACT

A bias circuit comprises a first stabilizing power supply circuit for absorbing variations in the supply voltage and a control circuit for imparting a desired temperature dependence on the level of an output voltage from the first stabilizing power supply circuit. The control circuit is driven by a regulated voltage from a second stabilizing power supply circuit. As a result, the level of the output voltage from the first stabilizing power supply circuit changes based upon the controlled conditions in the control circuit and in dependence upon changes in temperature. However, the level of the output voltage does not change with changes in the supply voltage. Since no positive feedback loop is included in the bias circuit, stable operation can be expected. Consequently, the bias circuit of the invention is suitable to be employed as a bias circuit for driving a semiconductor integrated circuit.

10 Claims, 7 Drawing Figures

Fig. 1 PRIOR ART
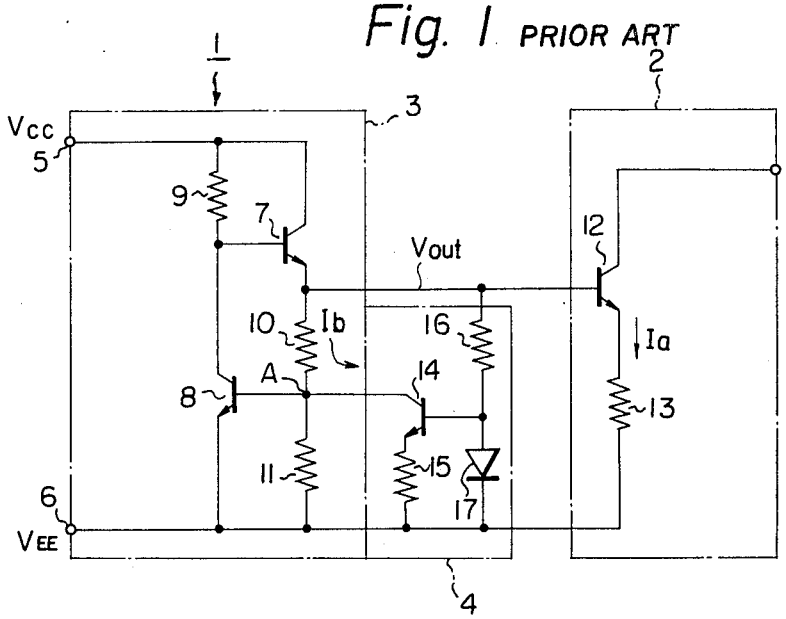
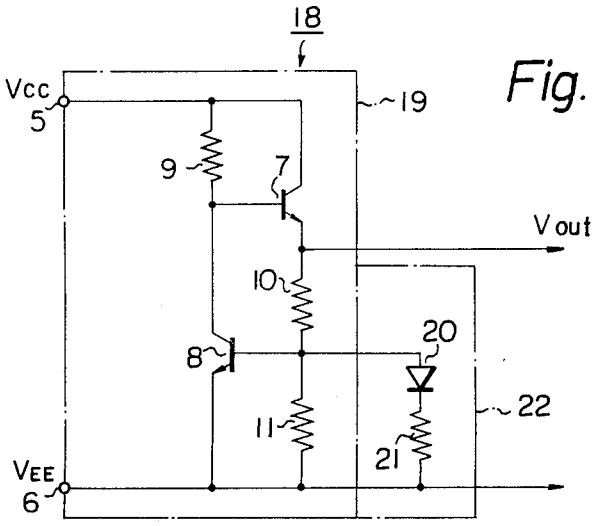
Fig. 2

BIAS CIRCUIT

BACKGROUND OF THE INVENTION

This invention relates to a bias circuit, and more particularly to a bias circuit suitable for a power source for supplying a bias voltage to be applied to a semiconductor integrated circuit.

If, for example, an output level of a semiconductor integrated circuit is varied according to a power supply voltage variation or ambient temperature change, it becomes difficult for the integrated circuit to maintain a required noise immunity and accordingly to assure stable operation of the circuit. Therefore, a bias circuit for supplying a bias voltage to a semiconductor integrated circuit should be constructed so that even if the input voltage applied to the bias circuit is varied, the bias voltage, will not vary. However, the bias voltage may be varied with the fluctuation in ambient temperature so as to compensate for a temperature characteristic in the output level of the semiconductor integrated circuit. Various proposals have been advanced to solve the problem (e.g. "Fully Compensated Emitter Coupled Logic", H. H. Muller, et al., ISSCC Digest of Technical Papers, p. 168–169, FIG. 2, February 1973, or "A Simple Three-Terminal IC Boundgap Reference", A. P. Brokaw, IEEE Journal of Solid State Circuits, vol. sc-9, no-6 p. 388–393, December 1974). A known bias circuit which has been proposed for satisfying the aforesaid requirements comprises a voltage regulator and a temperature compensating circuit. An output voltage from the voltage regulator is applied to the temperature compensating circuit, as a power supply voltage, to impart a required temperature characteristic to the voltage regulator. The temperature compensating circuit imparts a temperature characteristic that will compensate for a temperature characteristic of the semiconductor integrated circuit. This bias circuit, however, has a disadvantage of possibly causing oscillation due to a positive feedback loop formed therein.

Therefore, it is difficult for such a conventional bias circuit to expect a stable operation. In view of this, the assignee of the present application has previously proposed a bias circuit which does not include a positive feedback loop, but can achieve temperature compensation (Japanese Utility Model Application No. 52-177560). However, in this bias circuit, the circuit for imparting the required temperature characteristic is directly affected by power supply voltage variation, so that it is impossible to satisfactorily carry out a voltage regulating operation.

SUMMARY OF THE INVENTION

It is, therefore, an object of the present invention to provide a bias circuit capable of assuring a stable operation.

Another object of the invention is to provide a bias circuit in which the level of the output voltage is not affected by fluctuation of the input voltage, but is variable according to any predetermined temperature characteristic.

A further object of the invention is to provide a bias circuit suitable as a bias power source for a semiconductor integrated circuit.

In accordance with the invention, a bias circuit comprises a detecting transistor for detecting supply voltage variation, a first stabilizing power supply circuit for absorbing the variation, and a control circuit for imparting a desired temperature dependence on the level of the output voltage from the first stabilizing power supply circuit. The control circuit comprises at least one semiconductor element whose device parameter is varied with changes in temperature, and the circuit comprising the semiconductor element is driven by a regulated voltage from a second stabilizing power supply circuit. An electrical change caused in the control circuit by the change of the device parameter is applied to the first stabilizing power supply. As a result, the level of the output voltage from the first stabilizing power supply circuit changes based upon the controlled conditions in the control circuit and in dependence on temperature change. However, the level of the output voltage does not change with the supply voltage variation. In accordance with the circuit arrangement mentioned above, since no positive feedback loop is included in the circuit, stable operation can be expected.

The bias circuit of the invention is suitable for employment as a bias circuit for driving a semiconductor integrated circuit. In this case, the control circuit is adapted so that a temperature characteristic of the output voltage of the bias circuit may compensate for a temperature characteristic of the semiconductor integrated circuit. Consequently, the level of the output voltage of the semiconductor integrated circuit can be maintained constant irrespective of temperature change.

BRIEF DESCRIPTION OF THE DRAWINGS

The invention may be better understood from the following detailed description of several representative embodiments, taken in conjunction with the accompanying drawings in which:

FIG. 1 is a circuit diagram of one form of a known bias circuit;

FIG. 2 is a circuit diagram of a second form of a known bias circuit;

DESCRIPTION OF THE PREFERRED EMBODIMENTS

Figure 3:
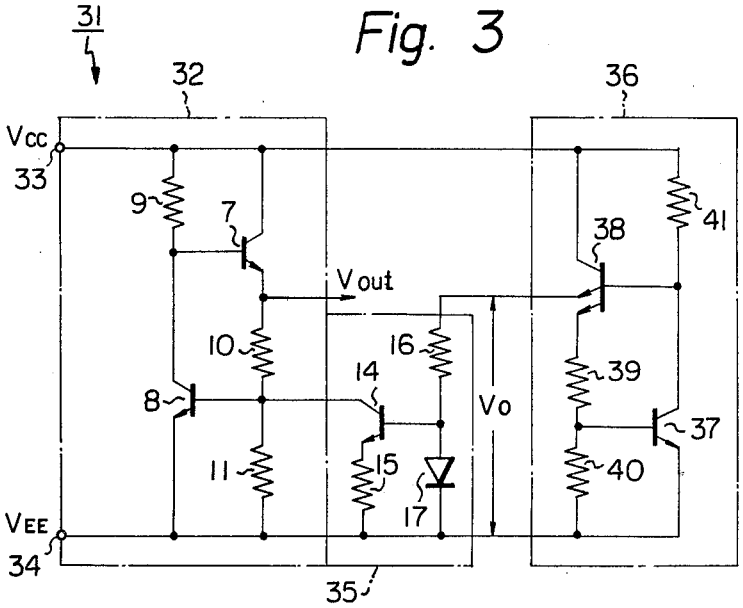
FIG. 3 is a circuit diagram of one embodiment of the present invention.

Prior to describing the present invention, known bias circuits will first be explained.

FIG. 1 illustrates a known bias circuit 1 together with a circuit 2 to be driven thereby. The bias circuit 1 comprises a stabilizing power supply circuit 3 and a temperature compensating circuit 4. The temperature compensating circuit is driven by a regulated output voltage $V_{out}$, from the stabilizing power supply circuit 3, for imparting a required temperature dependence to the output voltage. The stabilizing power supply circuit 3 has input terminals 5 and 6 to which a voltage $V_{CC}$ and a voltage $V_{EE}$ are applied, respectively, from a nonstabilized power supply (not illustrated). The circuit 3 is adapted to control a power supply voltage applied across the terminals 5 and 6 so that the voltage is output as a regulated output voltage $V_{out}$. The circuit 3 is a known circuit which comprises a transistor 7 for current control, a detecting transistor 8 for detecting a supply voltage variation, and resistors 9, 10 and 11. The base of the transistor 8 is connected to a junction A of the resistors 10 and 11 inserted in the emitter circuit of the transistor 7. The transistor 8 controls the base potential of the transistor 7 according to a voltage variation at the point A, so that the voltage $V_{out}$ is maintained constant irrespective of the variation of the input voltage. For example, assuming that the voltage $V_{EE}$ varies by $\Delta V_{EE}$, the value of $V_{out}-V_{EE}$ is reduced by $\Delta V_{EE}$, so that the potential at point A is changed by the voltage which is obtained by dividing $\Delta V_{EE}$ in accordance with the values of resistors 10 and 11. Due to this voltage change, the base-emitter voltage of the transistor 8 is reduced, so that the collector current of the transistor 8 is also decreased. As a result, the voltage drop at the resistor 9 is decreased, so that the potential at the base of the transistor 7 is increased. Therefore, the output voltage $V_{out}$ is also increased and the value of $V_{out}-V_{EE}$ is maintained at the predetermined constant value. The output voltage $V_{out}$ is applied to the base of a transistor 12 of a circuit 2 to be driven as a constant power supply. The emitter of the transistor 12 is connected to an input terminal 6 through a resistor 13.

Assuming that the resistance of the resistances 10, 11 and 13 are $R_1$, $R_2$ and $R_3$, respectively, the base-emitter voltage of the transistor 8 is $V_{BE8}$, and the base-emitter voltage of the transistor 12 is $V_{BE12}$, then:

$$V_{out} - V_{EE} = \frac{R_1 + R_2}{R_2} \cdot V_{BE8} \quad (1)$$

If the temperature coefficients of the resistors 10 and 11 are neglected, then:

$$\frac{d}{dT}(V_{out} - V_{EE}) = \frac{R_1 + R_2}{R_2} \cdot \frac{dV_{BE8}}{dT} \quad (2)$$

On the other hand, a current $I_a$ flowing through the resistor 13 can be expressed as:

$$I_a = (V_{out} - V_{EE} - V_{BE12})/R_3 \quad (3)$$

and when differentiated with respect to temperature T, it becomes:

$$\frac{dI_a}{dT} = \frac{1}{R_3}\left\{\frac{d}{dt}(V_{out} - V_{EE}) - \frac{dV_{BE12}}{dT}\right\} \quad (4)$$

From the equations (2) and (4) there can be obtained:

$$\frac{dI_a}{dT} = \frac{1}{R_3}\left(\frac{R_1 + R_2}{R_2} \cdot \frac{dV_{BE8}}{dT} - \frac{dV_{BE12}}{dT}\right) \quad (5)$$

where $$\frac{dV_{BE8}}{dT} \text{ and } \frac{dV_{BE12}}{dT}$$

depend upon the densities of the emitter currents of the transistors, respectively. With the equation (5), if $$\frac{dV_{BE8}}{dT} = \frac{dV_{BE12}}{dT} = \alpha(\text{constant})$$

then there can be obtained:

$$\frac{dI_a}{dT} = \frac{R_1}{R_2 \cdot R_3} \cdot \alpha \quad (6)$$

In brief, the constant current value $I_a$ of the constant current source depends upon a temperature coefficient of the base-emitter voltages of the transistors 8 and 12. Thus, the value $I_a$ varies according to fluctuations in temperature. Since the value of $\alpha$ is normally about $-1.5$ to $-2.0$ [mV/°C.], the current value $I_a$ decreases as the temperature rises.

A temperature compensating circuit 4 is provided so as to keep the current value $I_a$ constant even if the temperature changes. The temperature compensating circuit 4 comprises a transistor 14, resistor 15 and 16, and a diode 17. A current $I_b$ having a positive temperature coefficient is supplied to the resistor 10 to achieve temperature compensation. If the resistance value of the resistor 15 is $R_4$, a current to be supplied to the collector of the transistor 14 by way of the resistor 10 is $I_b$, a forward voltage of the diode 17 is $V_D$ and the base-emitter voltage of the transistor 14 is $V_{BE14}$, the current $I_b$ can be expressed by;

$$Ib = \frac{V_D - V_{BE14}}{R_4} \quad (7)$$

Accordingly, if the current density of the emitter current of the transistor 14 is $J_E$ and the density of a current flowing through the diode is $J_S$, then;

$$\frac{dI_b}{dT} = \frac{1}{R_4} \cdot \frac{k}{q} \, n \, \frac{J_E}{J_S} \quad (8)$$

As can be understood from the equation (8), the value of $dI_b/dT$ can be made positive or negative by suitably selecting the values of the current densities $J_E$ and $J_S$. If the expression is rearranged by substituting the formula:

$$V_{out} - V_{EE} = \frac{R_1 + R_2}{R_2} \cdot V_{BE8} + R_1 \cdot Ib \quad (9)$$

For the equation (4), there can be obtained:

$$\frac{dI_a}{dT} = \frac{1}{R_3} \quad \frac{R_1 + R_2}{R_2} \cdot \frac{dV_{BE8}}{dT} + \frac{R_1}{R_4} \cdot \frac{k}{q} \cdot m \frac{J_E}{J_S} \quad (10)$$

Therefore, the value of $dI_a/dT$ can be made zero by suitably selecting the value of $J_E/J_S$. As a result, a temperature compensation effect is obtained.

Although the resistor 11 is involved in the above-mentioned case, the above-mentioned operation may be carried out even if the resistor 11 is omitted. That is, since the change in the power supply voltage is detected as the change in the base current of the transistor 8 due to the resistor 10, as described above, the value of $V_{out}-V_{EE}$ is maintained at the predetermined constant value. With regard to the voltage change due to the temperature change, in the circuit condition in which the resistor 11 is omitted, since only the value of $R_2$ in the equation (10) becomes infinite, the first term of the equation (10) becomes $$\frac{1}{R_3} \cdot \frac{dV_{BE8}}{dT}.$$

Therefore, the temperature compensation for the output voltage $V_{out}$ is carried out in accordance with the second term of the equation (10) as before.

However, this bias circuit 1 has a positive feedback loop comprising the resistor 16, the transistor 14, the transistor 8 and the transistor 7. Due to this positive feedback loop, the bias circuit 1 has a possibility of oscillation and it is difficult to assure stable operation.

To obviate the above-mentioned drawback, there has been proposed a bias circuit having no positive feedback loop (Japanese Utility Model Application No. 52-177560). This bias circuit 18, however, has, as illustrated in FIG. 2, a stabilizing power supply circuit 19 which has a circuit construction identical, to that of the stabilizing power supply circuit 3 in the bias circuit 1, illustrated in FIG. 1, and has a temperature compensating circuit 22, comprised of a diode 20 a resistor 21, and connected in parallel to a resistor 11. Therefore, although the bias circuit 18 includes no positive feedback loop, the temperature compensating circuit 22 is subjected to direct influence of supply voltage variation. For this reason, the known bias circuit illustrated in FIG. 2 also has the defect that it cannot completely satisfy both the requirements, i.e., absorption of the supply voltage variation and temperature compensation simultaneously.

FIG. 3 illustrates one form of a bias circuit embodying the present invention. The bias circuit 31 has a stabilizing power supply circuit 32. The circuit 32 has input terminals 33 and 34, to which voltages $V_{CC}$ and $V_{EE}$ from nonstabilized power supply (not illustrated) are applied, respectively. A power supply voltage applied across the terminals is regulated so that it is output as a regulated output voltage $V_{out}$. Since the arrangement of the circuit 32 is identical to that of the stabilizing power supply circuit 3 in the known bias circuit 1, elements in the circuit 32 corresponding to the elements in the circuit 3 are denoted by the same numerals and/or letters. The bias circuit 31 is further provided with a temperature compensating circuit 35. The temperature compensating circuit 35 is provided for the same purpose as the temperature compensating circuit 4 illustrated in FIG. 1. A regulated output voltage $V_0$ from a stabilizing power supply circuit 36 is applied to the temperature compensating circuit 35 as a power source. The arrangement of the temperature compensating circuit 35 is identical to that of the circuit 4 in FIG. 1 and, therefore, identical elements are denoted by the same numerals and/or letters.

The stabilizing power supply circuit 36 is a known circuit and is comprised of a transistor 37, a multi-emitter transistor 38 and resistors 39 to 41. This circuit 36 serves to stabilize a voltage across the terminals 33 and 34 and the regulated output voltage $V_0$ is taken out from an emitter $E_1$ of the multi-emitter transistor 38. The voltage $V_0$ is applied to the temperature compensating circuit 35.

As described with regard to the prior circuit, the level of the voltage $V_o$ is affected by the temperature change, and the level change of the voltage $V_o$ is transmitted to the junction point of the transistor 14 and the diode 17 in the temperature compensating circuit. However, the current $I_b$ for temperature compensating in the equation (7) depends upon the voltage difference between the transistor 14 and the diode 17, but the current $I_b$ is not effected by any of the voltage changes in the transistor 14 and the diode 17. Therefore, the operation of the temperature compensating circuit is not effected by the change of the voltage $V_o$ due to the temperature change.

Consequently, the bias circuit 31 of the present invention differs from the known bias circuit illustrated in FIG. 1 in that electric power for the temperature compensating circuit 35 is supplied from an independent stabilizing power supply circuit 36 separately from the output voltage $V_{out}$. As a result, the bias circuit 31 includes no positive feedback loop and, accordingly, stable operation can be expected. Furthermore, the level of the output voltage $V_{out}$ can be varied in accordance with a required temperature dependence by the temperature compensating circuit 35, and the level of the output voltage $V_{out}$ can be maintained at a desired value irrespective of variations in the power supply voltage by the action of the circuit 32. The operations of the stabilizing power supply circuit 32 and the temperature compensating circuit 35 are similar to those of the corresponding circuits in the bias circuit illustrated in FIG. 1 and the detailed description thereof is omitted here. Since the stabilizing power supply circuit 36 is provided for the purpose of applying a regulated voltage to the temperature compensating circuit 35, as will be understood from the foregoing description, it should not be limited to the arrangement illustrated in FIG. 3 and it may be another type of stabilizing power supply circuit.

Figure 4:
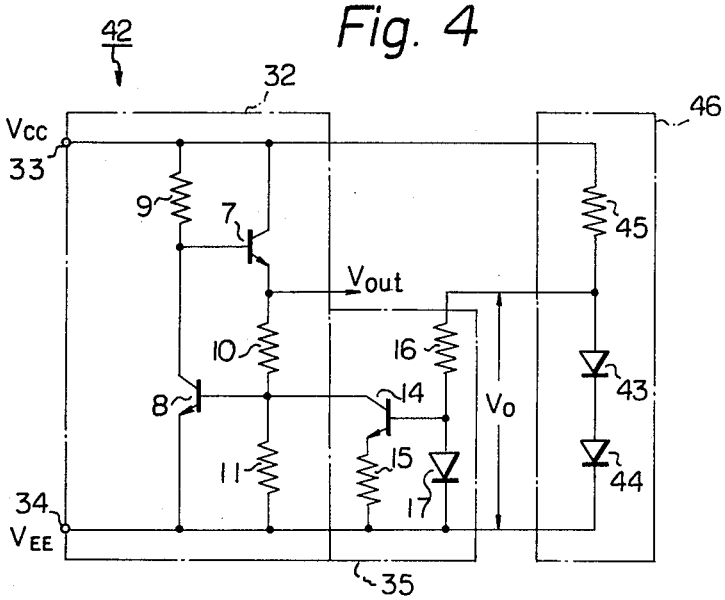
FIG. 4 is a circuit diagram of a modification of the embodiment illustrated in FIG. 3.

FIG. 4 illustrates a modification of the embodiment illustrated in FIG. 3. A bias circuit illustrated in FIG. 4 differs from the embodiment of FIG. 3 in that a regulated voltage $V_0$ to be applied to the temperature compensating circuit 35 is supplied from a stabilizing power supply circuit 46 comprising diodes 43 and 44, and a resistor 45. The circuit 46 is economical in that it can be formed with a small number of components. Since the parts of the bias circuit 42 are the same as those of the bias circuit illustrated in FIG. 3, except for the stabilizing power supply circuit 46, like parts are designated by like numerals and/or letters.

Figure 5:
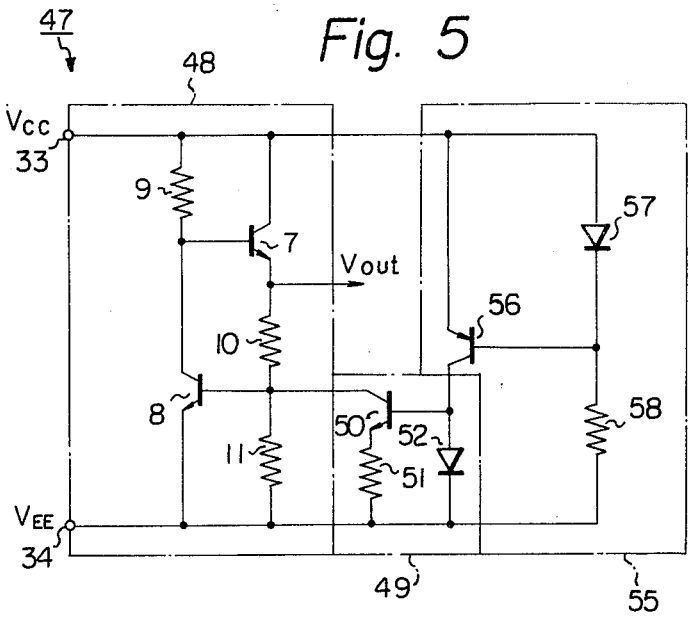
FIG. 5 is a circuit diagram of a second embodiment of the invention.

Another embodiment of the invention is illustrated in FIG. 5. A bias circuit 47 comprises a stabilizing power supply circuit 48 identical to the stabilizing power supply circuit 32 illustrated in FIG. 3 and a temperature compensating circuit 49. The temperature compensating circuit 49 is employed for the same purpose as the temperature compensating circuit 35 of FIG. 3, and is comprised of a transistor 50, a resistor 51 and a diode 52. Numeral 55 designates a known constant current circuit, which comprises a transistor 56, a diode 57 and a resistor 58. A constant voltage, irrespective of variation in a power supply voltage, is applied across the base and emitter of the transistor 56 by a series circuit of the diode 57 and the resistor 58. As a result, a constant current flowing through the collector of the transistor 56 is supplied to the temperature compensating circuit 49. Accordingly, currents flowing through the transistor 50 and the diode 52 can be maintained at required values, respectively, even if the supply voltage varies. Then, a required temperature dependence is imparted to an output voltage $V_{out}$ irrespective of supply voltage variations. Furthermore, the output voltage $V_{out}$ can be maintained at a desired value irrespective of the supply voltage variation by the circuit 48 in the same manner as in the case of the embodiment illustrated in FIG. 3.

Figure 6:
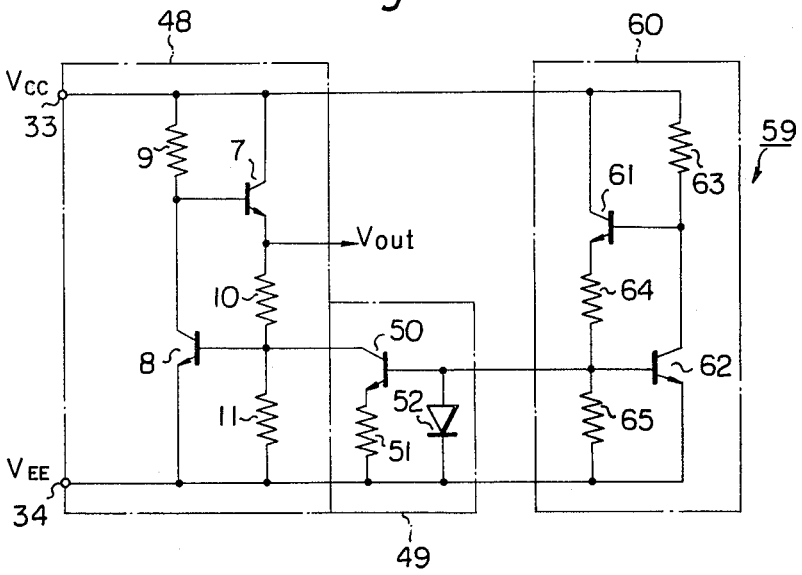
FIG. 6 is a circuit diagram of a modification of the embodiment illustrated in FIG. 5.

FIG. 6 illustrates a modification of the embodiment illustrated in FIG. 3. In a bias circuit 59, a constant voltage circuit 60 is employed, instead of the stabilizing power supply circuit 36 employed in the bias circuit illustrated in FIG. 3. In the circuit illustrated in FIG. 6, a resistor 64 corresponds to the parallel circuit of the resistors 16 and 39 in FIG. 3, and the multi-emitter transistor 38 is changed to a single emitter transistor 61. The constant voltage circuit 60 comprises transistors 61 and 62, and resistors 63, 64 and 65. The circuit construction of the circuit 60 is the same as that of the stabilizing power supply circuit 48. A constant voltage appearing at a junction of the resistors 64 and 65 is applied to the temperature compensating circuit 49. The operation of this bias circuit 59 is similar to that of the bias circuit illustrated in FIG. 3.

Figure 7:
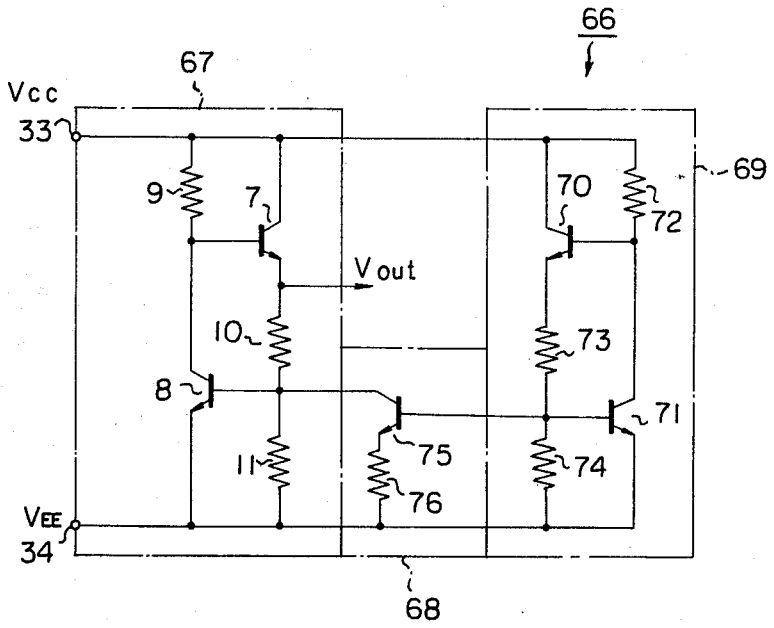
FIG. 7 is a circuit diagram of a third embodiment of the invention.

FIG. 7 illustrates still another form of bias circuit embodying the invention. The bias circuit 66 has: a stabilizing power supply circuit 67 employed for the same purpose as the stabilizing power supply circuit 32 illustrated in FIGS. 3 and 4, and the stabilizing power supply circuit 48 illustrated in FIGS. 5 and 6, and arranged similarly to them; a temperature compensating circuit 68 for imparting a required temperature dependence to an output voltage $V_{out}$ of the circuit 67, and; a constant voltage circuit 69 for applying a regulated voltage to the temperature compensating circuit 68. Since the stabilizing power supply circuit 67 has an arrangement similar to that of the circuits 32 and 48 as described above, elements corresponding to the elements in the circuits 32 and 48 are designated by corresponding numerals and/or letters in FIG. 7, and they are not described in detail here. The constant voltage circuit 69 comprises transistors 70 and 71, and resistors 72, 73 and 74, and a regulated voltage at the junction of the resistors 73 and 74 is applied to the base of a transistor 75 in the temperature compensating circuit 68. The emitter of the transistor 75 is connected to an input terminal 34 through the resistor 76, and the collector thereof is connected to a junction of resistors 10 and 11.

The temperature compensating circuit 68 supplies a current, having a temperature characteristic determined by a synthetic characteristic of a temperature characteristic of the base-emitter voltage of the transistor 75 and a temperature characteristic of a base-emitter voltage of the transistor 71 in the constant voltage circuit 69, to the collector of the transistor 75 through the resistor 10. In other words, this embodiment differs from the embodiment of FIG. 6 in that the temperature compensating circuit 68 has no element corresponding to the diode 52 as illustrated in FIG. 6 and the transistor 71 performs the function of the diode 52. Thus, the bias circuit 66 has an advantage in that the number of elements employed is small.

From the foregoing description, it will be understood that, according to the present invention, the bias voltage of the temperature compensating circuit is sufficiently stabilized, since the temperature compensating circuit for the supply voltage variation detecting active element in the circuit for absorbing the supply voltage variation is separated from the regulated output voltage of the supply voltage absorbing circuit and connected to the independently provided constant voltage power supply circuit. In addition, the temperature compensating circuit does not form a positive feedback loop and the entire circuit is free from any possibility of causing oscillation and operates stably. Thus, the bias circuit of the invention is suitable for use in applying a stabilized bias voltage to a semiconductor integrated circuit, such as a logic circuit.

What is claimed is:

1. A bias circuit, having first and second terminal for a connection to a supply voltage, comprising:

a first stabilizing power supply circuit for supplying a regulated output voltage at a regulated output voltage terminal, said first stabilizing power supply circuit having a control current terminal and a detecting transistor, for receiving a control current and for detecting and absorbing variations in the supply voltage, said regulated output voltage varying in dependence upon said control current;

a temperature compensating circuit, operatively connected to said control current terminal of said first stabilizing power supply circuit, for supplying said control current to said first stabilizing power supply circuit, said control current causing said regulated output voltage to vary with the ambient temperature; and a second stabilizing power supply circuit, operatively connected to said temperature compensating circuit, for supplying a constant voltage to said temperature compensating circuit, said second stabilizing power supply circuit comprising:

a first transistor, having a collector operatively connected to the first terminal, having a first emitter operatively connected to said temperature compensating circuit, having a second emitter, and having a base;

a first resistor operatively connected to the first terminal and operatively connected to the base of said first transistor at a first node;

a second resistor operatively connected to the second emitter of said first transistor;

a second transistor having a collector operatively connected to said first node, having a base operatively connected to said second resistor at a second node and having an emitter operatively connected to the second terminal; and a third resistor operatively connected between said second node and the second terminal.

2. A bias circuit as set forth in claim 1, wherein said first stabilizing power supply circuit comprises:

a fourth resistor operatively connected to the supply voltage at the first terminal and operatively connected to the collector of said detecting transistor at a third node;

a current control transistor, having a collector operatively connected to the first terminal, having a base operatively connected to said third node, and having an emitter operatively connected to said regulated output voltage terminal;

a fifth resistor operatively connected to said regulated output voltage terminal and operatively connected to the base of said detecting transistor and to said temperature compensating circuit at said control current terminal; and a sixth resistor operatively connected to said control current terminal and operatively connected to the supply voltage at the second terminal.

3. A bias circuit as set forth in claim 1 or 2, wherein said temperature compensating circuit comprises:

a seventh resistor operatively connected to the first emitter of said first transistor;

a first diode operatively connected to said seventh resistor at a fourth node and operatively connected to the second terminal;

a third transistor, having a collector operatively connected to said control current terminal, having a base operatively connected at said fourth node, and having an emitter; and an eighth resistor operatively connected to the emitter of said third transistor and operatively connected to the second terminal.

4. A bias circuit, having first and second terminals for connection to a supply voltage, comprising:

a first stabilizing power supply circuit for supplying a regulated output voltage at a regulated output voltage terminal, said first stabilizing power supply circuit having a control current terminal and a detecting transistor, for receiving a control current and for detecting and absorbing variations in the supply voltage, said regulated output voltage varying in dependence upon said control current;

a temperature compensating circuit, operatively connected to said control current terminal of said first stabilizing power supply circuit, for supplying said control current to said first stabilizing power supply circuit, said control current causing said regulated output voltage to vary with the ambient temperature; and a second stabilizing power supply circuit, operatively connected to said temperature compensating circuit, for supplying a constant voltage to said temperature compensating circuit, said second stabilizing power supply circuit comprising:

a first resistor operatively connected to the first terminal and operatively connected to said temperature compensating circuit at a first node; and first and second diodes operatively connected in series between said first node and the second terminal.

5. A bias circuit as set forth in claim 4, wherein said first stabilizing power supply circuit comprises:

a second resistor operatively connected to the supply voltage at the first terminal and operatively connected to the collector of said detecting transistor at a second node;

a current control transistor, having a collector operatively connected to the first terminal, having a base operatively connected at said second node, and having an emitter operatively connected to said regulated output voltage terminal;

a third resistor operatively connected to said regulated output voltage terminal and operatively connected to the base of said detecting transistor and to said temperature compensating circuit at said control current terminal; and a fourth resistor operatively connected to said control current terminal and operatively connected to the supply voltage at the second terminal.

6. A bias circuit as set forth in claim 4 or 5, wherein said temperature compensating circuit comprises:

a fifth resistor operatively connected at said first node;

a third diode operatively connected to said fifth resistor at a third node and operatively connected to the second terminal;

a first transistor, having a collector operatively connected to said control current terminal, having a base operatively connected at said third node, and having an emitter; and a sixth resistor operatively connected to the emitter of the said first transistor and operatively connected to the second terminal.

7. A bias circuit, having first and second terminals for connection to a supply voltage, comprising:

a first stabilizing power supply circuit for supplying a regulated output voltage at a regulated output voltage terminal, said first stabilizing power supply circuit having a control current terminal and a detecting transistor, for receiving a control current and for detecting and absorbing variations in the supply voltage, wherein said regulated output voltage varies in dependence upon said control current;

a temperature compensating circuit, operatively connected to said control current terminal of said first stabilizing power supply circuit, for supplying said control current to said first stabilizing power supply circuit, said control current causing said regulated voltage output to vary with the ambient temperature; and a second stabilizing power supply circuit, operatively connected to said temperature compensating circuit, for supplying a constant voltage to said temperature compensating circuit, said second stabilizing power supply circuit comprising:

a first resistor operatively connected to the first terminal;

a first transistor, having a collector operatively connected to the first terminal, having a base operatively connected to said first resistor at a first node, and having an emitter;

a second resistor operatively connected to the emitter of said first transistor and operatively connected to said temperature compensating circuit at a second node;

a second transistor, having a collector operatively connected at said first node, having a base operatively connected at said second node, and having an emitter operatively connected to the second terminal; and a third resistor operatively connected between said second node and the second terminal.

8. A bias circuit as set forth in claim 7, wherein said first stabilizing power supply circuit comprises:

a fourth resistor operatively connected to the supply voltage at the first terminal and operatively connected to the collector of said detecting transistor at a third node;

a current control transistor, having a collector operatively connected to the first terminal, having a base operatively connected at said third node, and having an emitter operatively connected to said regulated output voltage terminal;

a fifth resistor operatively connected to said regulated output voltage terminal and operatively connected to the base of said detecting transistor and to said temperature compensating circuit at said control current terminal; and a sixth resistor operatively connected to said control current terminal and operatively connected to the supply voltage at the second terminal.

9. A bias circuit as set forth in claim 7 or 8, wherein said temperature compensating circuit comprises:

a third transistor, having a collector operatively connected to said control current terminal, having a base operatively connected at said second node, and having an emitter; and a seventh resistor operatively connected to the emitter of said third transistor and operatively connected to the second terminal.

10. A bias circuit as set forth in claim 9, wherein said temperature control circuit further comprises a diode operatively connected between said second node and the second terminal.

* * * * *

UNITED STATES PATENT AND TRADEMARK OFFICE

CERTIFICATE OF CORRECTION

PATENT NO. : 4,322,676

DATED : March 30, 1982

INVENTOR(S) : KAZUHIRO TOYODA

It is certified that error appears in the above—identified patent and that said Letters Patent is hereby corrected as shown below:

Column 3, line 51, "$\frac{d}{dt}$" should be --$\frac{d}{dT}$--.

Signed and Sealed this

*Twenty-fourth* Day of *August 1982*

[SEAL]

*Attest:*

GERALD J. MOSSINGHOFF

*Attesting Officer*

*Commissioner of Patents and Trademarks*